United States Patent [19]

Rogers, Jr.

[11] Patent Number: 4,660,264

[45] Date of Patent: Apr. 28, 1987

[54] HEAT EXCHANGER MANUFACTURE PROCESS

[75] Inventor: Elmer H. Rogers, Jr., Murrysville, Pa.

[73] Assignee: Aluminum Company of America, Pittsburgh, Pa.

[21] Appl. No.: 766,808

[22] Filed: Aug. 19, 1985

Related U.S. Application Data

[62] Division of Ser. No. 665,188, Oct. 26, 1984, Pat. No. 4,593,755.

[51] Int. Cl.[4] ..... B21D 39/06

[52] U.S. Cl. ..... 29/157.4; 29/446; 29/464

[58] Field of Search ..... 29/157.4, 446, 464

[56] References Cited

FOREIGN PATENT DOCUMENTS 260 1/1979 Japan ..... 29/157.4

*Primary Examiner*—Albert W. Davis, Jr.

*Attorney, Agent, or Firm*—Daniel A. Sullivan, Jr.

[57] ABSTRACT

A method is disclosed of assembling a tube into two non-parallel tube sheets. The tube ends are placed in mandrels. The mandrels are moved into the holes in the tube sheets by bending the tube. The tubes are provided with convex concave curvature to provide the necessary flexibility to aid assembly.

1 Claim, 6 Drawing Figures

HEAT EXCHANGER MANUFACTURE PROCESS

This is a divisional of co-pending application Ser. No. 665,188 filed on Oct. 26, 1984 now U.S. Pat. No. 4,593,755 granted June 10, 1986.

SUMMARY OF THE INVENTION

It is an object of the invention to provide a new heat exchanger which is particularly suitable for use in conjunction with high pressure operations in fluid beds.

Another object is to provide a tube layout in a fluid bed heat exchanger that: (1) adds structural strength; (2) aids in the redistribution of fluidizing gas; (3) provides large heat exchange surfaces in a small volume, and (4) provides multipaths for cooling or heating media.

These as well as other objects which will become apparent from the discussion that follows are achieved, according to the present invention, by providing a heat exchanger including a plurality of tubes arranged in at least three side-by-side planes, the tubes being held at their ends in the sidewalls of an even-sided polygon of at least six sidewalls, each sidewall being connected to its opposite sidewalls by tubes in at least one of the planes.

DESCRIPTION OF THE PREFERRED EMBODIMENTS

Figure 1:
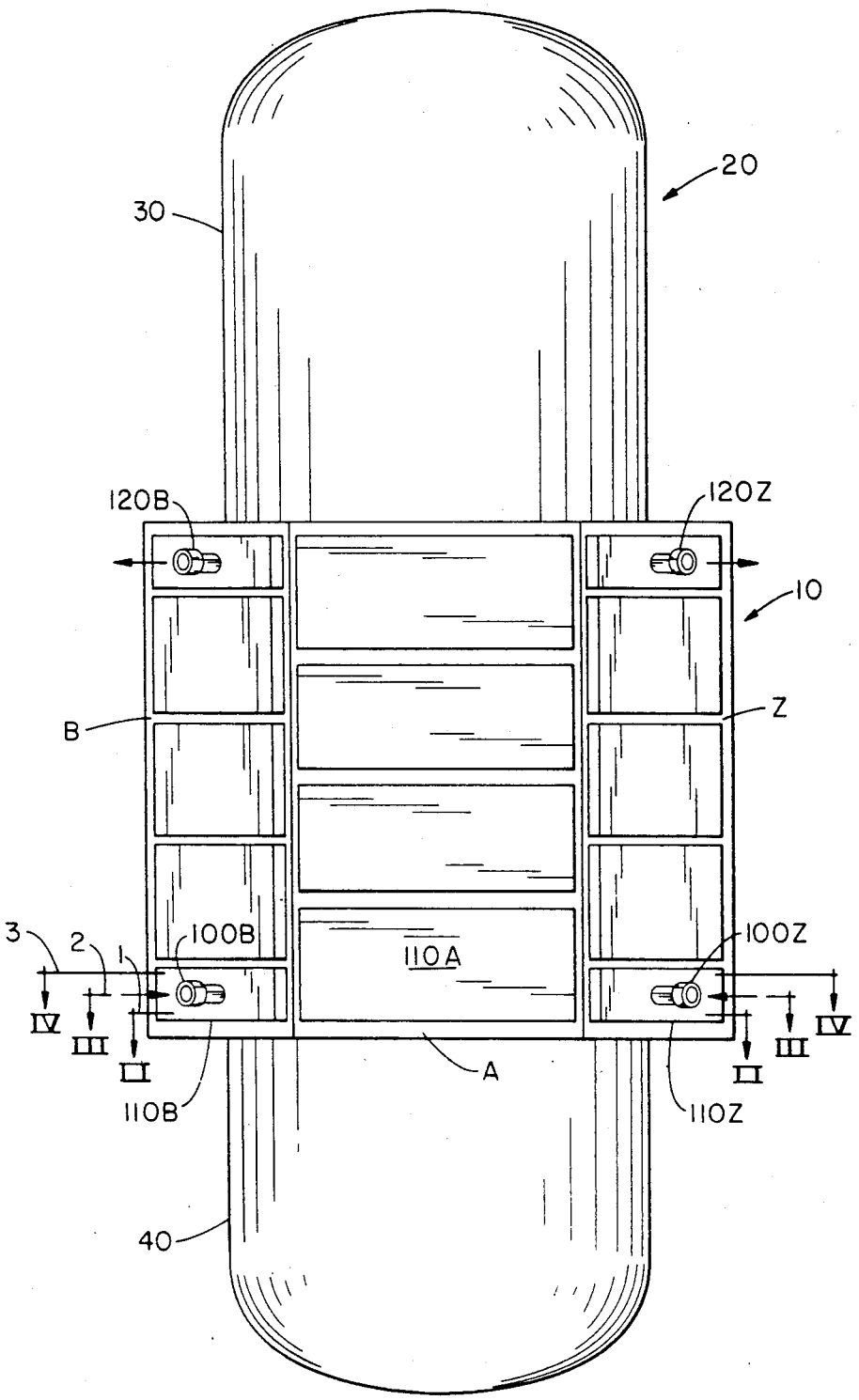
FIG. 1 is an elevational view of a fluidized bed incorporating one embodiment of the invention.

With reference first to FIG. 1, the heat exchanger 10 forms a portion of fluidized bed containment vessel 20. The upper part of the vessel is an inverted cylindrical cup 30, while the lower part is formed by cylindrical cup 40.

Depending on the particular process being performed in the vessel, various supply and removal lines (not shown) will lead to and from the vessel. For example, there can be a fluidizing gas supply line coming into the bottom of cup 40, along with solids supply and removal lines. The bottom of cup 40 will also typically seat a grid for distributing the fluidizing gas to provide a uniformly fluidized bed of solid particles.

With reference to all the Figures, the heat exchanger includes six sidewalls A, B, C, X, Y and Z. Within the six sidewalls are 24 side-by-side, horizontal planes, each containing a plurality of tubes. The tubes are held at their ends in the sidewalls. Connection can be done by welding or brazing the tube ends to the sidewalls. The numbering system used for the tubes is "a" through "j" within a plane, prefixed by the number of the plane, planes 1 to 3 being shown in FIGS. 2 to 4 respectively.

Arranged on the outsides of the sidewalls are water boxes. The tubes open into the boxes. The boxes participate in conducting a heat exchanger fluid, as will be explained below. The boxes may be separate from one another, as shown, or formed by internal partitions.

Each of the sidewalls is connected to its opposite sidewall by tubes in at least one of the side-by-side planes. For instance, opposing sidewalls C and Z are connected by mutually parallel tubes 1*d* to 1*g*. This feature strengthens the polygonal section and permits vessel 20 to be used as a pressure vessel. It is an effect like that of stayed heads in boilers. The tubes connecting the opposing sidewalls can also be partially replaced or supplemented by solid rods for added strength.

Tubes 1*d* to 1*g* are evenly spaced from one another. The spaces to the sides of this set of tubes connecting the opposite sidewalls are filled with lateral tubes 1*a* to 1*c* and 1*h* to 1*j*. The lateral tubes run parallel to the central tubes and are spaced at the same, even spacing. The ends of the lateral tubes turn toward the sidewalls lateral to the opposing sidewalls and connect perpendicularly into the lateral sidewalls.

Comparing any given plane of tubes with a next adjoining plane, the tubes in one plane are rotated 60° with respect to the tubes in the other planes. This can be seen, for instance, by a comparison of FIGS. 2 and 3, or 3 and 4.

Assembly of the tubes in the tube sheets forming the sidewalls is simply a matter of inserting the straight tubes, e.g. 1*d* to 1*g*, into holes drilled for them in the tube sheets.

Figure 5:
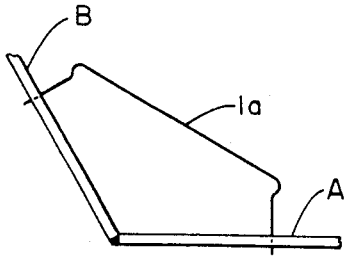
FIGS. 5 and 6 are detail views also taken on cutting plane II—II.
Figure 6:
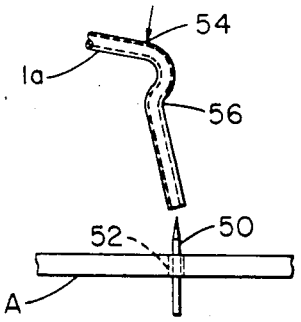

In the case of the lateral tubes, their bending at their ends to join the lateral tube sheets perpendicularly in holes drilled perpendicular to the tube sheets requires a different method of assembly. The perpendicular orientation of the holes requires that the tubes undergo further bending as their ends move into the holes. This assembly is done as illustrated in FIGS. 5 and 6 for tube 1*a*. One end of the tube is run onto mandrel 50 in hole 52 in tube sheet A. Then, the other end is pushed onto a corresponding mandrel (not shown) in the appropriate hole in tube sheet B. Hitting the tube with a rubber hammer at point 54 and at the corresponding location on the other end, coupled with a withdrawing of the mandrels, causes the tube to pop into place as shown by the schematic representation of 1*a* in FIG. 6.

It is advantageous to start assembly with the shortest tubes and to insert straight tubes last.

Figure 2:
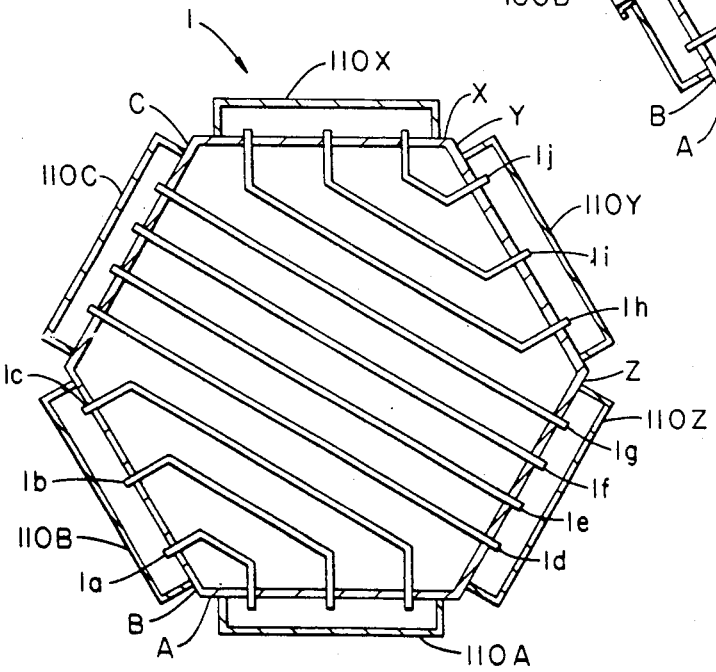

Provision of the convex curvature at 54 and the concave curvature at 56, as contrasted with the sharp bends shown schematically in FIG. 2, provides flexibility to aid the assembly of the lateral tubes with the lateral tube sheets.

Securement of the tube ends in the tube sheets is by conventional means as described in *Chemical Engineers' Handbook,* by Robert H. Perry and Cecil H. Chilton, McGraw-Hill Book Company, Fifth Edition, page 11—11, and *Metals Handbook,* American Society for Metals, Volume 4, 8th Edition, page 436. Grooved tube holes and three-roll expanders are used to form a strong joint. A seal weld may also be applied.

Figure 3:
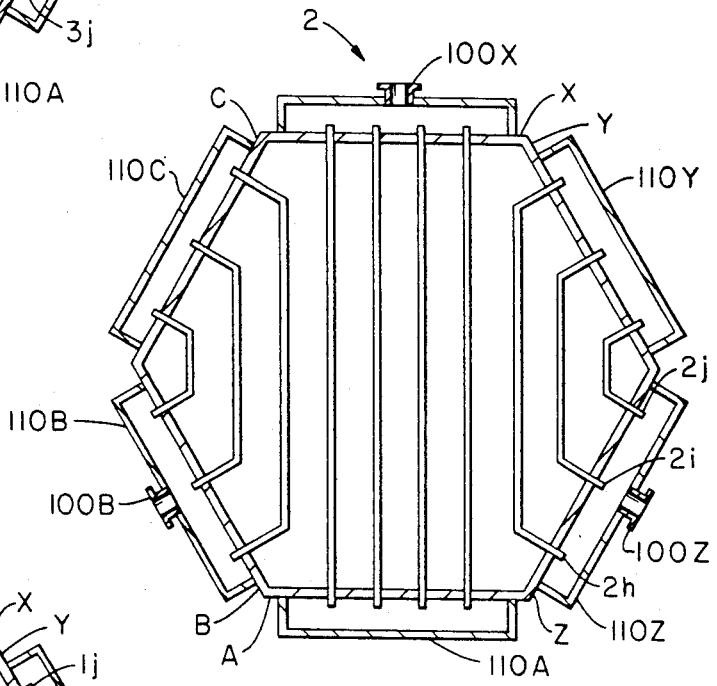

To use the heat exchanger, water (a liquid example of a heat exchanger fluid) is introduced below, into inlets 100Z, 100B and 100X (this last appearing only in FIG. 3). The water flows through the tubes and box passageways and leaves above, through outlets 120B, 120Z and 120X (this last is not shown).

Figure 4:
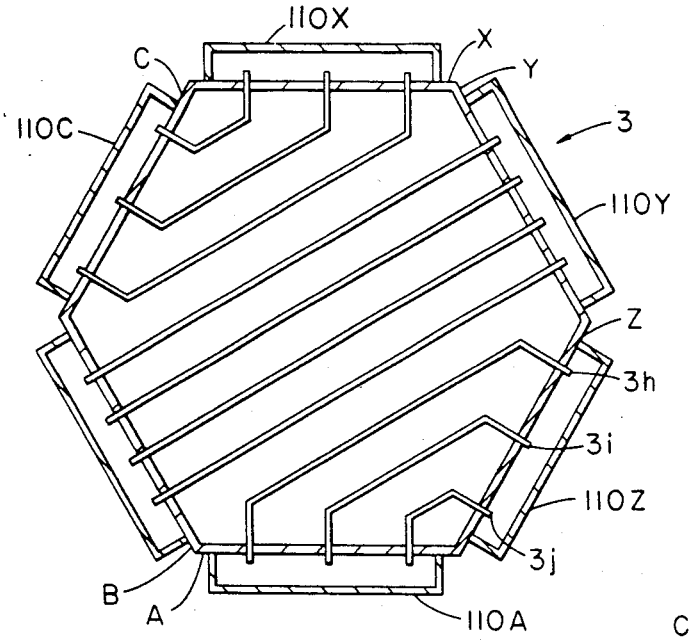
FIGS. 2 to 4 are cross sections taken as shown by the cutting planes II—II to IV—IV in FIG. 1.

In further explanation of the flow in FIG. 1, water enters e.g. inlet 100Z. Fed from supply box 110Z are tubes on three levels: lowermost level 1 (FIG. 2), upon that, level 2 (FIG. 3), and, upon level 2, level 3 (FIG. 4).

Considering first level 1 (FIG. 2), water from box 110Z goes in straight tubes 1*d* to 1*g* back to box 110C.

On level 2 (FIG. 3), water from box 110Z goes in bent tubes 2*h* to 2*j* to box 110Y.

On level 3 (FIG. 4), water from box 110Z goes in bent tubes 3*h* to 3*j* to box 110A.

Considering how the water from inlet 100Z went to three different locations, depending on which tube level was being fed from box 110Z, it will be realized that box 110A, for instance, receives water from the three different inlets 100B, 100Z and 100X.

This water coming into box 110A in its lower half then leaves by flowing from the upper half of box 110A into tubes on the next three levels above level 3.

Advantages of this invention include the provision of a large heat exchange surface per unit volume. In addition, the tube arrangement provides structural strength to the container vessel, thereby allowing pressure operations of the system. The tube arrangement also provides an excellent gas redistribution mechanism by providing a uniform shadow from the tubes onto a gas distribution grid below. Thus, fluidizing gas tends to converge in a bed unless it is redistributed. Baffles are normally used. Here, the tubes themselves form baffles.

The tube density can be held constant or varied across the horizontal and/or vertical cross section of the vessel. The uniform tube density of the illustrated embodiment is preferred. An uneven tube density can allow the fluidizing gas to channel upwards through areas of few tubes and disrupt the required fluidization. On the other hand, some processes require a greater gas flow in the middle, or vice versa, and these can be accommodated by departures from the even tube spacing of the illustrated embodiment.

As implied by the Summary of the Invention, the invention is applicable to even-sided polygons of more than six sides.

An example illustrative of extension of the invention to a regular octagonal cross section is given by the following particulars. This heat exchanger is not illustrated in the drawings.

The heat exchanger has four planes 1 to 4, 1 being the lowermost. There are eight sidewalls 1 to 8, numbered clockwise as seen from above. Each sidewall has one water box on it, and each water box extends across all four planes. Each plane has eight tubes, four in the middle for staying opposing sidewalls, and two laterals on each side of the middle tubes.

On plane 1, the opposing sidewalls 3 and 7 are stayed by four straight-across tubes, while two lateral tubes extend between sides 2 and 8 and another two run between sides 4 and 6.

On plane 2, the tubes run at right angles to those in plane 1, when both planes are observed from above. The opposing sidewalls of plane 2 interconnected by four straight tubes are sides 1 and 5. Two lateral tubes interconnect sides 2 and 4, and two lateral tubes interconnect sides 6 and 8.

On plane 3, the tubes run at 45° to the tubes in plane 2, when both planes are viewed from above. The interconnected opposing sidewalls on plane 3 are sides 4 and 8, with one lateral pair joined by the lateral tubes being sides 1 and 3, the other being sides 5 and 7.

On plane 4, the tubes run at 90° to the tubes in plane 3, when both planes are viewed from above. The opposing, tube-stayed sides are 2 and 6, the interconnected lateral wall pairs being 3 and 5, and 1 and 7.

Respecting the water flow, feed from an external water source into the heat exchanger is into the boxes on sides 1 and 2, while flow out of the heat exchanger to an external water receiver is from the boxes on sides 3 and 4.

Within the heat exchanger, water flows from the box on side 1 into four tubes on plane 2 to run to the box on side 5, into two tubes on plane 3 to run to the box on side 3, and into two tubes on plane 4 to run to the box on side 7. This flow situation for side 1 is given in Table I, where "x" represents flow out of the box into tubes and "o" represents flow out of tubes into the box. The numeral preceding the "x" or "o" indicates the number of tubes involved. A "—" means no tubes open into the box on that plane. The number following the "x" or "o" represents the side the other ends of the tubes are connected to.

TABLE I

| | Water Flow in Octagonal Heat Exchanger | | | | | | | |
|---|---|---|---|---|---|---|---|---|
| | Side | | | | | | | |
| Plane | 1 | 2 | 3 | 4 | 5 | 6 | 7 | 8 |
| 1 | — | 2 × 8 | 407 | 206 | — | 2 × 4 | 4 × 3 | 202 |
| 2 | 4 × 5 | 2 × 4 | — | 202 | 401 | 2 × 8 | — | 206 |
| 3 | 2 × 3 | — | 201 | 408 | 2 × 7 | — | 205 | 4 × 4 |
| 4 | 2 × 7 | 4 × 6 | 205 | — | 2 × 3 | 402 | 201 | — |

Application of the invention to a ten-sided regular polygon is more like the hexagonal case. Half the number of sides is an odd number. That is, half of ten is five, an odd number, and half of six (the hexagonal case) is three, also odd. In general, where the number of sides N on the polygon is twice an odd number, the planes can carry parallel tubes, each succeeding plane can be rotated 360°/n with respect to the preceding plane, and the first n planes are fed, or drained, from n boxes, corresponding to boxes 110B, 110X and 110Z.

Applying these principles to a heat exchanger having a ten-sided regular polygonal cross section, its structure is sketched as follows.

Numbering its sides 1 to 10 clockwise as viewed from above, a ten-plane heat exchanger has water inlet boxes, five planes high (planes 1 to 5 counting from the bottom), on sides 1, 3, 5, 7 and 9, and outlet boxes five planes high (planes 6 to 10) on the same sides 1, 3, 5, 7 and 9. The remaining sides have water boxes extending ten planes high.

As an example, each plane has ten tubes. Considering plane 1, four middle tubes go from side 1 to side 6, two lateral tubes go from side 7 to side 10, one lateral tube from side 8 to side 9, two lateral tubes from side 2 to side 5 and one lateral tube from side 3 to side 4.

On plane 2, the middle tubes go from side 2 to side 7.

The remainder of the structure follows the established pattern, plane 3 having the middle tubes going from side 3 to side 8, etc.

While the invention has been described in terms of preferred embodiments, the claims appended hereto are intended to encompass all embodiments which fall within the spirit of the invention.

What is claimed is:

1. A method of assembling a tube with two non-parallel tube sheets, comprising running both end of the tube onto mandrels and moving the ends on the mandrels into holes in the sheets, the orientation of the holes requiring bending of the tube as the ends move into the holes, the orientation of the holes being perpendicular to the tube sheets, the tube being provided with curvature providing flexibility to aid the assembling, said curvature being a convex (54), concave (56) curvature.

* * * * *

UNITED STATES PATENT AND TRADEMARK OFFICE

CERTIFICATE OF CORRECTION

PATENT NO. : 4,660,264

DATED : April 28, 1987

INVENTOR(S) : Elmer H. Rogers Jr.

It is certified that error appears in the above-identified patent and that said Letters Patent is hereby corrected as shown below:

Table I, Col. 4 Replace Table I with the following:

Table I

Water Flow in Octagonal Heat Exchanger

| | Side | | | | | | | |
|---|---|---|---|---|---|---|---|---|
| Plane | 1 | 2 | 3 | 4 | 5 | 6 | 7 | 8 |
| 1 | - | 2x8 | 4o7 | 2o6 | - | 2x4 | 4x3 | 2o2 |
| 2 | 4x5 | 2x4 | - | 2o2 | 4o1 | 2x8 | - | 2o6 |
| 3 | 2x3 | - | 2o1 | 4o8 | 2x7 | - | 2o5 | 4x4 |
| 4 | 2x7 | 4x6 | 2o5 | - | 2x3 | 4o2 | 2o1 | - |

Column 4, line 60, Claim 1, "end" should read -- ends --.

Signed and Sealed this

Eighteenth Day of August, 1987

*Attest:*

*Attesting Officer*

DONALD J. QUIGG

*Commissioner of Patents and Trademarks*